US005346564A

United States Patent [19]

Vance et al.

[11] Patent Number: 5,346,564

[45] Date of Patent: Sep. 13, 1994

[54] METHOD OF SAFELY PREPARING AN EXPLOSIVE EMULSION COMPOSITION

[75] Inventors: Ricky T. Vance, Cordova, Ala.; George L. Griffith, Bethlehem, Pa.; Dennis J. Brown, Jasper, Ala.

[73] Assignee: Nelson Brothers, Inc., Parrish, Ala.

[21] Appl. No.: 77,686

[22] Filed: Jun. 16, 1993

[51] Int. Cl.[5] ..... D03D 23/00; D03D 43/00

[52] U.S. Cl. ..... 149/109.6

[58] Field of Search ..... 149/109.6, 45, 46

[56] References Cited

U.S. PATENT DOCUMENTS 3,642,547 2/1972 Conrad ..... 149/2

4,790,891 12/1988 Halliday et al. ..... 149/2

5,244,475 9/1993 Lownds et al. ..... 149/118

*Primary Examiner*—Donald P. Walsh

*Assistant Examiner*—Anthony R. Chi

*Attorney, Agent, or Firm*—Burns, Doane, Swecker & Mathis

[57] ABSTRACT

The invention relates to a method of safely preparing stable water-in-oil emulsion explosives. After formation of the emulsion explosive, it is cooled in a heat exchanger which uniformly cools the emulsion. The physical characteristics of the heat exchanger also limit the extent of detonation if it should occur. In order to improve stability of the emulsion explosive, the oxidizer is blended with the emulsion subsequent to cooling the emulsion.

12 Claims, 1 Drawing Sheet

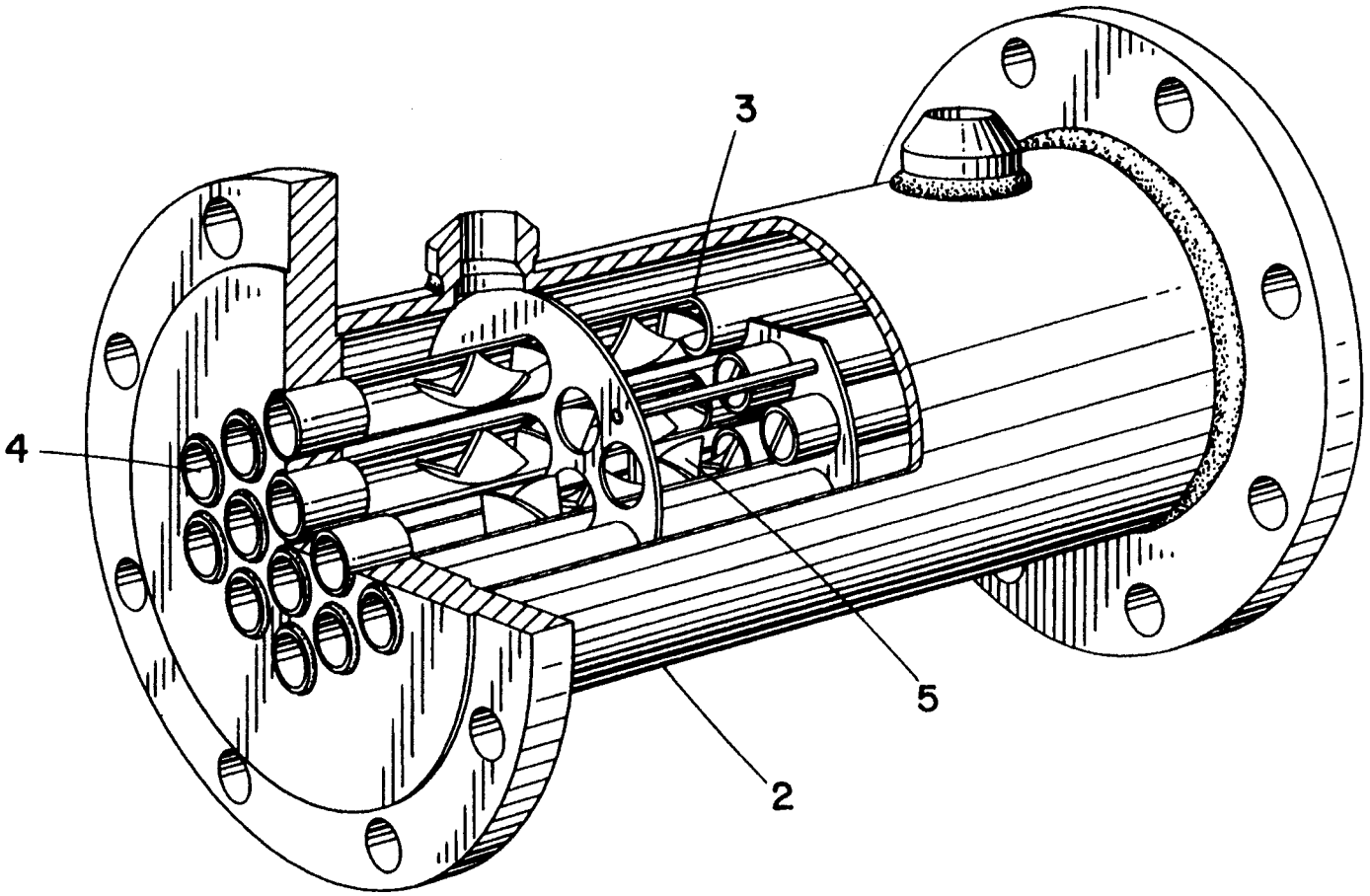
3
5
2
4

METHOD OF SAFELY PREPARING AN EXPLOSIVE EMULSION COMPOSITION

BACKGROUND OF THE INVENTION

The present invention relates to the preparation of explosive compositions by combining a blend of a water-in-oil emulsion and solid particulate inorganic nitrate in the form of prills or granules. More particularly, the present invention relates to a method for stabilizing explosive compositions by cooling the emulsion in a shell and tube heat exchanger. The invention also concerns the fabrication of storage-stable explosive compositions useful in the loading and detonating of drill holes.

Explosives which comprise a blend of a water-in-oil emulsion and solid particulate inorganic nitrate, such as ammonium nitrate (AN), have always captured the interest of blasters owing to the fact that they are able to offer the advantages of high bulk density, blasting energy, and water resistance characteristic of emulsion explosives, while at the same time resulting in cost reductions owing to the lower cost of AN. Among the problems that may be encountered in connection with the use of emulsion explosives, however, are those of emulsion stability during processing, and the stability of the blend's explosive and theological properties.

An inherent problem with emulsion explosives is their relative instability, due to the fact that they comprise a thermodynamically unstable dispersion of supercooled solution or melt droplets in an oil-continuous phase. If the emulsion remains stable during processing, the supercooled droplets are prevented from crystallizing or solidifying into a lower energy state. If the emulsion weakens or becomes unstable, however, then crystallization or solidification of the droplets results, and the explosive generally loses at least some of its sensitivity to detonation and becomes too viscous to handle for certain blasting applications.

Moreover, when solid components are added to emulsion explosive, such as glass microspheres for density reduction or AN/ANFO prills for increased energy or particles of oxidizer salt, such solid components tend to destabilize emulsions even further. The solid components may disrupt the continuous fuel phase and provide a site for resulting crystallization of the discontinuous oxidizer salt solution phase. In addition, the prills often contain fines and/or clay or have a coating that act as poisons to the emulsion thereby hastening its destabilization. Since emulsion and prill combinations must remain stable during handling and for a period of time after being loaded into a drill hole in order to remain reliably detonable, the presence of AN or ANFO prills can present serious stability problems.

There have been processes developed in the industry for purposes of increasing a blend's explosive and theological properties. In U.S. Pat. No. 3,642,547 (Conrad) an emulsion explosive is stabilized during sensitization by homogeneously mixing a gas into an emulsion. This controls the product density and allows storage of the explosive for over a year without affecting the detonation sensitivity. U.S. Pat. No. 5,076,867 (McKenzie), relates to a method of stabilizing a mixture of emulsion and AN or ANFO prills by dissolving a surfactant in a liquid organic fuel prior to adding the fuel to the AN prills. Additionally, efforts have been made to reduce water loss from the emulsion blend to prevent crystallization and subsequent desensitization of the blend. See U.S. Pat. No. 4,555,278 (Cescon et al.).

Safety is another concern in the industry. There have been several methods developed in the explosives industry to increase the safety of manufacturing emulsion explosives. For example, U.S. Pat. No. 3,766,820 describes a process of detecting and trapping possible detonations of melted explosives.

U.S. Pat. No. 5,076,867 relates to a method for stabilizing a detonable mixture of emulsion and AN or ANFO prills. The method involves dissolving a surfactant in a liquid organic fuel prior to adding the fuel to AN prills for forming ANFO prills, or if AN prills are used without added liquid organic fuel, the surfactant is added to the prills. The prills containing the surfactant are then mixed with the emulsion.

Other efforts have been directed to reducing agitation of sensitive emulsion explosives by developing improved mixing devices. In U.S. Pat. No. 4,213,712 (Aanonsen et al.), a rotor mixer which traps detonations of an emulsion explosive is described. Additionally, emulsion explosives have been mixed using a combination of an in-line static mixer and a low-shear mechanical mixer in order to reduce generation of heat during high-shear mechanical mixing. See U.S. Pat. No. 4,948,440 (Cribb et al.)

However, there remains a need for increased safety during the manufacture of explosive compositions. Moreover, there is also a need for an explosive emulsion having stable explosive and rheological properties.

SUMMARY OF THE INVENTION

According to the invention, there is provided a method for safely preparing a stable emulsion explosive. After forming a water-in-oil emulsion, the emulsion is cooled using a shell and tube heat exchanger. The heat exchanger is provided with tubes having effective diameters less than the critical diameter necessary to sustain detonation of the emulsion. Accordingly, the heat exchanger traps any explosion that may occur therein.

Moreover, the shell and tube heat exchanger cools the emulsion uniformly. That is, there is no detectable variation in temperature throughout the width of the emulsion stream exiting the heat exchanger. By providing uniform cooling, the sensitivity of the emulsion is maintained.

Subsequent to cooling the emulsion, AN/ANFO prills are added to the emulsion to provide sensitivity. By mixing the AN/ANFO prills with the emulsion after uniform cooling, crystallization of the emulsion-prill mixture and breakdown of the prill coating is reduced. Thus, the invention maintains the sensitivity of the explosive mixture as measured by its rate of detonation (ROD). The stability of the emulsion has also been found to be significantly increased.

BRIEF DESCRIPTION OF THE DRAWINGS

In the accompanying drawing, the invention is illustrated in which:

The FIGURE illustrates a particular shell and tube heat exchanger useful in the process according to the present invention.

DETAILED DESCRIPTION

The present invention is based on the discovery that heat exchangers used for cooling emulsion explosives affect the safety of manufacturing such explosives. Additionally, the cooling process has been found to affect the ultimate properties of the resulting explosives.

The emulsion is formed by first dissolving inorganic oxidizer salts in water at an elevated temperature of from about 25° C. to about 90° C. or higher, depending on the crystallization temperature of the salt solution. The salt solution is generally a solution of alkali or alkaline earth metal nitrates, perchlorates or chlorates such as ammonium nitrate, sodium nitrate, potassium nitrate, calcium nitrate or potassium perchlorate or a combination thereof. However, ammonium nitrate is the most preferred.

The inorganic oxidizer salt solution, which forms the aqueous phase of the emulsion, generally comprises an inorganic oxidizer salt in an amount ranging from about 45% to about 95% by weight of the entire water-in-oil emulsion and preferably from about 60% to 80%.

Water, introduced via the oxidizer salt solution, is employed in amounts of from about 1% to about 30% by weight of the emulsion. Preferably, the water content ranges from about 9% to about 20%, although emulsions can, if desired, be formulated which are essentially devoid of water.

In such instances, water-miscible organic liquids can at least partially replace water as a solvent for the inorganic oxidizer salts, and such liquids may also function as a fuel for the composition. Moreover, certain organic compounds also reduce the crystallization temperature of the oxidizer salts in solution. Miscible solid or liquid fuels can include urea; alcohols, such as sugars and methyl alcohol; glycols, such as ethylene glycols; amides, such as formamide; amines; amine nitrates; and analogous nitrogen-containing fuels. As is well known in the art, the amount and type of water-miscible liquid(s) or solid(s) used can vary according to the desired physical properties.

The salt solution (the aqueous phase of the emulsion) is then mixed with an immiscible liquid organic fuel or oil (the oil phase) and an emulsifier in a conventional mechanical emulsifier with sufficient shear to form a water-in-oil emulsion. The emulsifying mixer should be of the type that produces low heat levels with low impact force on the emulsion.

The immiscible organic fuel, which forms the oil phase of the emulsion, is present in an amount of from about 3% to about 15%, and preferably in an amount of from about 4% to about 9% by weight of the emulsion. The actual amount used can be varied depending upon the particular immiscible fuel(s) used and upon the presence of other fuels, if any. The immiscible organic fuels can be aliphatic, alicyclic, and/or aromatic and can be saturated and/or unsaturated, so long as they are liquid at the formulation temperature. Preferred fuels include tall oil, mineral oil, waxes, paraffin oils, benzene, toluene, xylenes, mixtures of liquid hydrocarbons generally referred to as petroleum distillates such as gasoline, kerosene and diesel fuels, and vegetable oils such as corn oil, cotton seed oil, peanut oil and soybean oil. Particularly preferred liquid fuels are mineral oil, No. 2 fuel oil, paraffin waxes, microcrystalline waxes and mixtures thereof. Aliphatic and aromatic nitrocompounds and chlorinated hydrocarbons also can be used. Mixtures of any of the above can be used.

In addition to the immiscible liquid organic fuel, solid or other liquid fuels or both can be employed in selected amounts. Examples of solid fuels which can be used are finely divided aluminum particles; finely divided carbonaceous materials such as gilsonite or coal; finely divided vegetable grain such as wheat; and sulfur. These additional solid and/or liquid fuels can be added generally in amounts ranging up to about 25% by weight.

The emulsifiers according to the present invention can be selected from those conventionally employed and are used generally in an amount of from about 0.2% to about 5% by weight of the emulsion, more preferably from about 0.5% to about 4% by weight, and most preferably in the range of from about 0.75 to about 2% by weight of the emulsion. Typical emulsifiers include sorbitan fatty esters, glycerol esters, substituted oxazolines, alkylamines or their salts, lecithin or thermally altered lecithin, derivatives thereof and the like. Additionally, certain polymeric emulsifiers, such as a bis-alkanolamine or bis-polyol derivative of a bis-carboxylated or anhydride derivatized olefinic or vinyl addition polymer, have been found to impart better stability to emulsions under certain conditions. Other suitable emulsifiers include polyamine derivatives of polyisobutenyl phenol and derivatives of polyisobutenyl succinic anhydride and alkanol amines. Mixtures of the foregoing emulsifiers can also be used.

Subsequent to blending the above mentioned components in a mechanical emulsifier, the resulting emulsion may be further mixed in another mechanical emulsifier or in an in-line static mixer, such mixers being well known in the art. Static mixers achieve emulsification by continuous splitting and layer generation and the rearrangement and reunification of the incoming stream. An example of a suitable mixer is a static mixer manufactured by Koch Corporation.

The emulsion is then cooled by a heat exchanger which provides uniform cooling and mixing of the fluid. Any heat exchanger having these characteristics is suitable. However, the heat exchanger is preferably a shell and tube heat exchanger. The shell and tube heat exchanger 2,illustrated in FIG. 1, advantageously provides uniform cooling of the incoming stream of emulsion such that there is no measurable temperature variation within the emulsion outlet stream exiting the heat exchanger.

Moreover, the shell and tube heat exchanger 2 can advantageously act as a "detonation trap" in the event of an explosion. Due to the fact that detonations (or explosions) proceed in the form of a wave having a particular frequency, such detonations require a specific amount of free volume to allow propagation of the wave and enable spreading of the detonation. In the event of an explosion, there exists a limiting diameter of the tube 3, defined as the "critical diameter", at which the detonation wave will not propagate. According to the invention, detonation waves produced by an explosion are thereby prevented from proceeding through the entire length of the heat exchanger 2 because the effective diameter 4 of each process tube 3 is less than the "critical diameter" necessary to sustain any such waves. Accordingly, the safety provided by the shell and tube heat exchanger 2 is far greater than that provided by ordinary heat exchangers having no such tubes.

The heat exchanger 2 according to the invention should be sufficiently efficient to cool high viscosity liquids that are typical of emulsion explosives. The emulsion of the invention possesses a viscosity ranging from about 20,000 to about 50,000 cp., and preferably ranging from about 30,000–40,000 cp. Additionally, the emulsions normally have relatively low specific heats ranging from about 0.3 to 0.7, and preferably ranging from about 0.45–0.50. In order to more efficiently and uniformly cool the emulsion, the shell and tube heat exchanger 2 may be equipped with static mixer elements 5 within the heat exchanger tubes 3. These elements 5 aid in eliminating temperature gradients in the emulsion stream while still maintaining plug flow characteristics. As well, the effective diameter of the tubes are further reduced by the presence of the mixing elements.

The shell and tube heat exchanger of the present invention should be constructed of materials suitable for handling water-in-oil emulsion explosives. For example, various steel alloys which do not corrode or oxidize in the presence of emulsion explosives compositions mentioned above are preferred. However, stainless steel is the more preferable material of construction.

The shell and tube heat exchanger provides additional advantages over conventional plate type exchangers, such as:

1.) Better mixing action of the components and thus better temperature consistency within the material;
2.) Lower shear imparted to the emulsion;
3.) Less cleaning maintenance required and increased ease in cleaning;
4.) Decreased fouling because there are no "dead" spots (dead spots being volume within the exchanger in which there is little or no circulation of fluid);
5.) Less sensitive to pressure surges in the system; and
6.) Increased longevity of the exchanger. The emulsion should be cooled at least from about 10° to about 50° F., and preferably at least from about 30°–40° F., and most preferably about 35° F. The temperature of the emulsion entering the heat exchanger ranges from about 130° to about 190° F. and the outlet temperature of the cooled emulsion exiting the exchanger ranges from below about 120° to below about 170° F., and preferably from below about 130° to below about 150° F.

From the shell and tube heat exchanger, the emulsion is pumped to a conventional blender where other solid components are added, such as the solid density control agents and particulates of solid inorganic oxidizers, such as AN or ANFO prills. For example, the emulsion may be blended with the solid components by pumping it into a mixer or into an auger conveying the nitrate. The latter mode is convenient for making a packaged product. The turning of the screw in the auger blends the emulsion and solid components as well as transfers the blend into the package.

The AN/ANFO prills can be any of those used in the industry for manufacturing explosives. Typically, they are porous, low density prills that enhance the sensitivity of the explosive composition by contributing air voids or pockets to the composition. Ground or high density prills, however, also can be used. AN/ANFO prills generally have a surface coating to retard caking due to their hydroscopicity. The types of coating are inorganic parting agents, such as talcs and clays and organic crystal habit modifiers, such as alkylnapthalene sulfonates. As stated above, certain coatings have been found to destabilize or poison the emulsion when dissolved in the emulsion. By cooling, breakdown of the prill is reduced due to reduced thermal shock on the prill. As a result, less material which could destabilize or poison the emulsion is released into the emulsion. Also, the uniform cooling has been found to prevent solid AN from migrating through the phase walls of the emulsion and crystallizing, which also causes a breakdown of the emulsion.

The emulsion may be sensitized by adding a component which reduces the density of the emulsion. Such an adjustment in density may be performed during emulsion formation. However, it is preferable to sensitize the emulsion subsequent to cooling. By sensitizing the emulsion after cooling, crystallization of the emulsion is reduced. A chemical gassing agent may be employed for such a purpose. Chemical gassing agents preferably comprise sodium nitrite which reacts chemically in the composition to produce gas bubbles, and a gassing accelerator such as thiourea, to accelerate the decomposition process. A sodium nitritethiourea combination begins producing gas bubbles immediately upon addition of the nitrite to the oxidizer containing the thiourea, which solution preferably has a pH of about 4.5. The nitrite is added as a diluted aqueous solution in an amount of from less than 0.1% to about 0.4% by weight and the thiourea or other accelerator is added in a similar amount to the oxidizer solution.

In addition to or in lieu of chemical gassing agents, hollow spheres or particles made from glass, plastic or perlite may be added to provide density reduction. These solid density control agents, may be incorporated into the emulsion prior to cooling, but preferably are incorporated into the emulsion subsequent to cooling such as during the final blending process. These solid density cooling agents also can effect the stability of emulsion explosives.

Additionally, a surfactant may be blended into the explosive composition during the emulsion formation or subsequent to admixing the prills with the emulsion. The surfactant may include lecithin; phosphatidylethanolamine, phosphatidylinositol and phosphatidylcholine derivatives; esters; amides; imides; carboxylates; amines; polyamines; alcohols; polyols; ethers and combinations thereof. Thus, the surfactants may be amphoteric, cationic, non-ionic or anionic. A preferred surfactant is lecithin. Natural lecithin is most commonly derived from soybean plants and includes a mixture of organic materials such as soybean oil and phosphatidylcholine, phosphatidylethanolamine and phosphatidylinositol derivatives.

The surfactant may be added directly to the AN/ANFO prills, such as by spraying, in trace amounts up to 5% or more by weight of the prills. It also may be added to the fuel portion (immiscible organic fuels mentioned above) of the emulsion.

The AN/ANFO prills may then be added to the emulsion to form the explosive composition. The amount of the emulsion can vary from about 10% to about 90% by weight of the total composition and preferably from abut 25% to about 75%. The amount of AN/ANFO prills blended in the emulsion may range from about 90% to about 10% by weight of the total composition and preferably from about 75% to about 25%.

As above-mentioned, the inorganic oxidizer salt solution forming the discontinuous phase (the aqueous phase) of the emulsion generally comprises an inorganic oxidizer salt. Additionally, water and/or water-miscible organic liquids, in an amount of from about 0% to about 30% by weight of the emulsion may also be present in the aqueous phase. The oxidizer salt preferably is ammonium nitrate, but other salts may be used in amounts up to about 50%. The other oxidizer salts may include ammonium, alkali and alkaline earth metal nitrates, chlorates and perchlorates. Of these, sodium nitrate (SN) and calcium nitrate (CN) are preferred.

Following the blending process, the explosive composition is either packaged or placed into boreholes. The explosive blend may be delivered to be packaged or to boreholes by an auger or by pumping means.

A preferred technique for pumping the explosive blend into a borehole is to pump it through an annular stream of aqueous lubricating liquid, e.g., naturally occurring water, flowing through the conduit used to transfer the blend to the hole. As such, the resistance of the emulsion/prills blend to movement through a conduit is reduced by provision of an annular layer of liquid of low viscosity. An annulus of aqueous lubricating liquid, injected into the conduit through which the emulsion/prills blend is to be delivered to the borehole, provides sufficient lubrication to permit a column of the blend to slide through the conduit without undergoing appreciable deformation in shear, a distinct benefit for maintaining the emulsion structure of the blend.

By cooling the emulsion uniformly in a heat exchanger prior to combination with the inorganic oxidizer particulates, the explosive composition is substantially more stable and allows longer waiting periods between the loading of boreholes with blasting agent and the detonation of those holes. This allows long periods of time when the material may not be shot but is loaded into the ground. This is extremely important in a mining situation where it may take weeks to drill, load, and then shoot a shot.

Additionally, the process according to the invention provides an explosive composition that maintains its viscosity by reducing crystallization of the blend. After blending the emulsion with the prills, crystals begin to form in the mixture. These crystals are formed due to thermal cracking of the prill when mixed with hot emulsion. The prills proceed to the discontinuous phase (aqueous phase) and become more saturated, allowing the crystals to pierce the barrier between the aqueous and nonaqueous phases provided by the emulsion.

Other methods for maintaining the viscosity of mixture may be used. For example, the AN/ANFO prills may be coated with a substance in which the water diffusivity is low, i.e., in which water has a diffusion coefficient at 25° C. of more than about $10^{-5}$, and preferably less than about $10^{-8}$ $cm^2$/sec. Examples of such materials are solid or semi-solid hydrocarbons including paraffin wax and petroleum-rosin-paraffin.

Additionally, the viscosity of the mixture may be maintained by controlling the cell size of the emulsion's internal phase (the aqueous salt solution droplets) so as to decrease the chemical driving force, i.e., the difference between the chemical potential of the water in the dispersed aqueous salt solution of the emulsion and inorganic oxidizer particles/prills. A reduced chemical driving force minimizes the rate of water transport from the emulsion phase to the particles. The chemical potential of the components in the dispersed aqueous phase increases in inverse proportion to the radius of curvature of the cell (droplet). Therefore, smaller cell size increases the chemical potential of the water in the discontinuous phase, thereby increasing the driving force for water transport to the solid oxidizer particles. The optimum cell size of the internal phase of an emulsion in a blend is the largest possible which will not crystallize when water loss occurs. This insures a minimum rate of water transfer without premature crystallization of the emulsion. The optimum average cell size generally is from about 1 to about 6 microns, and more preferably from about 2 to 5 microns, decreasing as the aqueous phase water content decreases, or as the shear rate is increased.

Other factors also can be controlled to minimize water transport across the emulsion's continuous phase. Since the range of water transport not only is determined by the compositions of the continuous phase, but also decreased when the dimensional thickness of this phase is greater, the continuous phase may be made dimensionally thicker by increasing the oil content of the emulsion. This also imparts a lower viscosity to the emulsion and permits the formation of emulsion/prill blends with lower shear mixing which has an advantageous effect on the stability of the blend, i.e., decreases the crystallization of the blend. Moreover, a less viscous blend will be far more readily pumped.

The following Examples describe illustrative methods of preparing explosive compositions of the invention but are not to be interpreted as a limitation of the scope thereof.

EXAMPLE 1

An aqueous emulsion was manufactured using he following composition and parameters:

| | |
|---|---|
| Ammonium Nitrate | 76.4% |
| $H_2O$ | 15.6% |
| Hydrotreated Mineral Oils | 7.0% |
| Emulsifier | 1.0% |
| | 100.0% |

The ammonium nitrate and water were mixed and heated to 190° F. The mineral oil and emulsifier were mixed and heated to 90° F. a pre-emulsion was made using a low sheer stirring unit, the pre-mix apparent viscosity being 2000 cPs. the pre-mix was pumped through a series of static mixers at 175° F. thus producing an emulsion with an apparent viscosity of 35000 cP. This emulsion was then cooled through a shell and tube heat exchanger to 135° F. The emulsion was sensitized using glass microspheres and blended in a blend with ANFO in the following weight % proportions:

| | |
|---|---|
| % ANFO | 50 |
| % Emulsion | 50 |

The shelf life was checked and found to be 12 weeks with no significant crystallization.

COMPARATIVE EXAMPLE 1

A process for manufacturing an explosive was conducted according to Example 1, except that the emulsion was not cooled and mixed with ANFO at 175° F., as is common in the industry.

The shelf life was checked and found to be 6 weeks with moderate crystallization.

In order to demonstrate the uniform cooling of the shell and tube heat exchanger employed in the process according to the present invention, temperature measurements were taken at various points throughout the width of the emulsion stream exiting a shell and tube heat exchanger, as set forth in Example 2, and a plate heat exchanger as shown in Comparative Example 2, below.

EXAMPLE 2

A process for making explosives was conducted according to EXAMPLE 1 (the present invention) at different emulsion stream flow rates using a shell and tube heat exchanger. The temperature did not vary throughout the width of the emulsion outlet stream as shown in Table I below.

TABLE I

| FLOW RATE (lbs/hr) | | HEAT EXCHANGER TEST CHART TEMPERATURE (°F.) | | | | PRESSURE OF PROCESS (PSI) | |
|---|---|---|---|---|---|---|---|
| PROCESS MATERIAL | SHELL MATERIAL | PROCESS MATERIAL IN | PROCESS MATERIAL OUT | SHELL MATERIAL IN | SHELL MATERIAL OUT | IN | OUT |
| 3599.2 | 1420.6 | 176 (Tank) | | | | | |
| | | 170.5 (Inl.) | 161.5 (out) | 108 | 115 | 58 | 9 |
| | | 172.5 | 160.0 | 108 | 114 | 56.2 | 8.4 |
| 125.8 | 1416.2 | 177 (Tank) | | | | | |
| | | 152 (Inl.) | 129 (out) | 109 | 112 | 22.2 | 1.0 |
| | | 152.5 | 126.5 | 109 | 112 | 22.3 | 0.8 |
| | | 155.5 | 125 | 109 | 112 | 22.3 | 0.8 |
| 774.9 | 1422.7 | 176 (Tank) | | | | | |
| | | 170.5 (Inl.) | 157 (out) | 108 | 112.5 | 34.2 | 4.2 |
| | | 171.5 | 158 | 108.5 | 112.5 | 34 | 2.5 |
| | | 170.5 | 160 | 109 | 112.5 | 34.2 | 2.2 |
| | | 170.0 | 158 | 109.5 | 112.5 | 33.6 | 2.0 |

COMPARATIVE EXAMPLE 2

A process for making explosives was conducted according to Example 2 using a plate heat exchanger at different emulsion stream flowrates. The temperature of the outlet stream varied as much as 10.5° F. throughout the width of the stream as shown in Table II below.

TABLE II

| FLOW RATE (lbs/hr) | | HEAT EXCHANGER TEST CHART TEMPERATURE (°F.) | | | | PRESSURE OF PROCESS (PSI) | |
|---|---|---|---|---|---|---|---|
| PROCESS MATERIAL | SHELL MATERIAL | PROCESS MATERIAL IN | PROCESS MATERIAL OUT | SHELL MATERIAL IN | SHELL MATERIAL OUT | IN | OUT |
| 617.0 | 1477.2 | 186 (Tank) | | | | | |
| | | 167 | 138 to 147 | 105 | 110.5 | 27.8 | 6.8 |
| | | 168 | 152.5 to 160 | 105 | 110.5 | 27.3 | 6.4 |
| | | 169 | 149 to 158 | 107 | 112 | 27.5 | 6.6 |
| | | 170.5 | 145.5 to 156 | 108 | 113 | 27.7 | 6.6 |
| 251.3 | 1490.5 | 182 (Tank) | | | | | |
| | | 167 | 143.5 | 110 | 115.5 | 22.7 | 4.9 |
| | | 168 | 143.5 to 149 | 109.5 | 113 | 22.7 | 4.9 |
| | | 167 | 131 to 136.5 | 110 | 114 | 22.8 | 5.0 |

As illustrated by comparing the emulsion outlet temperatures of Tables I and II, the shell and tube heat exchanger cools the emulsion efficiently and uniformly. In particular, the temperature throughout the width of the outlet stream varies undetectably in the shell and tube heat exchanger (See Table I). However, the outlet stream temperature of the plate heat exchanger varies up to 10.5° F. throughout the width of the outlet stream. Due to the poor heat transfer characteristics of water-in-oil emulsion type explosives, it is generally very difficult to uniformly cool these emulsions which has been found to result in reduced stability. By utilizing a heat exchanger that cools the emulsion uniformly, such as a shell and tube heat exchanger of the present invention, emulsion explosives are provided that have improved stability.

COMPARATIVE EXAMPLE 3

The emulsion of Example 1 was blended with ANFO in weight % proportions of 25 emulsion/75 ANFO; 40 emulsion/60 ANFO and 50 emulsion/50 ANFO. The explosive emulsions were not cooled prior to the blending with ANFO. The blending occurred at a temperature of about 185° F.

The rate of detonation for each explosive was determined when first made, after one week, after two weeks, after three weeks and after four weeks. The results are given below:

| | Time (weeks) | Rate of Detonation (ft/sec.) |
|---|---|---|
| 25 emulsion/75 ANFO | Fresh | 11,667 |
| | 1 | 11,574 |
| | 2 | 11,052 |
| | 3 | 11,283 |
| | 4 | 7,991 |
| 40 emulsion/60 ANFO | Fresh | 11,905 |
| | 1 | 12,121 |
| | 2 | 13,889 |
| | 3 | 11,792 |
| | 4 | 9,432 |
| 50 emulsion/50 ANFO | Fresh | 18,519 |
| | 1 | 15,605 |
| | 2 | 12,491 |
| | 3 | 13,441 |
| | 4 | 13,349 |

The severe reduction in rate of detonation over a period of 4 weeks is indicative of poor shelf life, which equates to poor stability. If the explosives had been cooled in accordance with the present invention, for example, to about 135° F. or lower, prior to mixing with the ANFO, the shelf life and stability would have been much improved. For example, the 25 emulsion/75 ANFO would have exhibited a "fresh" rate of detonation of about 17,000 ft/sec., and a rate of detonation of 16,500 ft/sec. after 4 weeks. A cooled 40 emulsion/60 ANFO explosive would have exhibited a rate of detonation of about 16,900 ft/sec. fresh and a rate of detonation of about 16,400 ft/sec. after 4 weeks of storage. The 50 emulsion/50 ANFO mixture would have exhibited a rate of detonation of 19,000 ft/sec., and a rate of detonation of 18,500 ft/sec. after 4 weeks of storage.

While the present invention has been described with reference to certain illustrative examples and preferred embodiments, various modifications will be apparent to those skilled in the art and any such modifications are intended to be within the scope of the invention as set forth in the appended claims.

What is claimed is:

1. A method of preparing an explosive composition comprising:

(a) forming a water-in-oil emulsion explosive;

(b) uniformly cooling said emulsion using a shell and tube heat exchanger; and (c) adding an oxidizer to said emulsion.

2. A method according to claim 1, wherein the effective diameter of each tube of said heat exchanger is less than the critical diameter necessary to sustain detonation.

3. A method according to claim 2, wherein said heat exchanger is provided with static mixer elements within the tubes of said heat exchanger.

4. A method according to claim 1, wherein said heat exchanger maintains a constant temperature within said emulsion exiting said exchanger.

5. A method according to claim 1, wherein said cooling is conducted prior to adding salt oxidizer.

6. A method according to claim 1, wherein said oxidizer comprises an inorganic nitrate.

7. A method according to claim 1, wherein said oxidizer comprises ammonium nitrate prills.

8. A method of preparing an emulsion explosive composition comprising:

(a) forming a water-in-oil emulsion explosive;

(b) uniformly cooling said emulsion using a shell and tube heat exchanger, said heat exchanger provided with tubes having an effective diameter less than the critical diameter necessary to sustain detonation of said emulsion; and (c) adding an oxidizer to said emulsion.

9. A method of preparing a stable emulsion explosive composition comprising:

(a) forming a water-in-oil emulsion explosive; and (b) uniformly cooling said emulsion explosive using a shell and tube heat exchanger prior to adding an oxidizer.

10. A method according to claim 9, wherein the effective diameter of each tube of said shell and tube heat exchanger is less than the critical diameter necessary to sustain detonation.

11. A method according to claim 9, wherein said heat exchanger is provided with static mixer elements within the tubes of said heat exchanger.

12. A method according to claim 9, wherein said heat exchanger maintains a constant temperature with emulsion exiting the heat exchanger.

* * * * *